US011565261B2

(12) United States Patent
Podbiel

(10) Patent No.: US 11,565,261 B2
(45) Date of Patent: Jan. 31, 2023

(54) METHOD AND MICROFLUIDIC DEVICE FOR ALIQUOTING A SAMPLE LIQUID USING A SEALING LIQUID, METHOD FOR PRODUCING A MICROFLUIDIC DEVICE AND MICROFLUIDIC SYSTEM

(71) Applicant: Robert Bosch GmbH, Stuttgart (DE)

(72) Inventor: Daniel Sebastian Podbiel, Rutesheim (DE)

(73) Assignee: Robert Bosch GmbH, Stuttgart (DE)

( * ) Notice: Subject to any disclaimer, the term of this patent is extended or adjusted under 35 U.S.C. 154(b) by 163 days.

(21) Appl. No.: 16/976,847

(22) PCT Filed: Mar. 25, 2019

(86) PCT No.: PCT/EP2019/057376

§ 371 (c)(1),
(2) Date: Aug. 31, 2020

(87) PCT Pub. No.: WO2019/185508

PCT Pub. Date: Oct. 3, 2019

(65) Prior Publication Data

US 2020/0406262 A1 Dec. 31, 2020

(30) Foreign Application Priority Data

Mar. 27, 2018 (DE) ..... 10 2018 204 624.7

(51) Int. Cl.
*B01L 3/00* (2006.01)

(52) U.S. Cl.
CPC ..... *B01L 3/502769* (2013.01); *B01L 2200/0642* (2013.01); *B01L 2200/0673* (2013.01); *B01L 2200/0684* (2013.01); *B01L 2400/0487* (2013.01)

(58) Field of Classification Search
CPC ..... B01L 3/502769; B01L 2400/0487; B01L 2200/0642; B01L 2200/0673; B01L 2200/0684; G01N 2300/0864; G01N 2300/161
See application file for complete search history.

(56) References Cited

U.S. PATENT DOCUMENTS 5,053,060 A * 10/1991 Kopf-Sill ..... C02F 3/208 96/6
8,895,295 B2 11/2014 Ririe et al.
9,150,913 B2 10/2015 McBride et al.
2007/0003443 A1 1/2007 Sandell et al.
2007/0280857 A1 12/2007 Song et al.
2009/0084738 A1 4/2009 Momose
2012/0038774 A1 2/2012 Reimann et al.
2012/0039774 A1 2/2012 Yotoriyama et al.
2012/0132288 A1 5/2012 Weitz et al.
2013/0130262 A1 5/2013 Battrell et al.
2015/0352544 A1 12/2015 Buermann et al.
2017/0252744 A1 9/2017 Baroud et al.

FOREIGN PATENT DOCUMENTS

CN 101486004 A 7/2009
CN 201402261 Y 2/2010
CN 103153466 A 6/2013
CN 105916689 A 8/2016
CN 106111220 A 11/2016
CN 107424971 A 12/2017
CN 107427830 A 12/2017
CN 107525765 A 12/2017
DE 10 2007 045 638 A1 4/2009
EP 2 248 588 A1 11/2010
JP 2005-274199 A 10/2005

OTHER PUBLICATIONS

International Search Report corresponding to PCT Application No. PCT/EP2019/057376, dated May 27, 2019 (German and English language document) (5 pages).

* cited by examiner

*Primary Examiner* — Christopher Adam Hixson
(74) *Attorney, Agent, or Firm* — Maginot, Moore & Beck LLP

(57) ABSTRACT

A method for aliquoting a sample liquid using a sealing liquid in a microfluidic device includes combining the sample liquid and the sealing liquid, which have different wetting behaviors, to form a two-phase system separated by a boundary surface. The microfluidic device includes a chamber with at least one inlet channel for introducing the liquids and a plurality of cavities configured to be filled via the inlet channel. The inlet channel and the cavities have a geometry that is defined in dependence on the respective wetting behaviors of the sample liquid and the sealing liquid. The method first includes introducing the sample liquid to form a first meniscus configured by the defined geometry, e.g. concave, to fill the cavities. The method further includes introducing the sealing liquid to form a second meniscus configured by the existing, greater contact angle and the defined geometry, e.g. convex, to cover the filled cavities.

14 Claims, 11 Drawing Sheets a)

b)

c)

a)

b)

c)

METHOD AND MICROFLUIDIC DEVICE FOR ALIQUOTING A SAMPLE LIQUID USING A SEALING LIQUID, METHOD FOR PRODUCING A MICROFLUIDIC DEVICE AND MICROFLUIDIC SYSTEM

This application is a 35 U.S.C. § 371 National Stage Application of PCT/EP2019/057376, filed on Mar. 25, 2019, which claims the benefit of priority to Serial No. DE 10 2018 204 624.7, filed on Mar. 27, 2018 in Germany, the disclosures of which are incorporated herein by reference in their entirety.

BACKGROUND

The disclosure proceeds from a device or a method of the type of the claims.

Microfluidic analysis systems, called lab-on-a-chip systems, permit automated, reliable, compact and inexpensive processing of chemical or biological substances for medical diagnostics. By the combination of a multitude of operations for controlled manipulation of fluids, it is possible to achieve complex microfluidic process operations.

A fundamental operation is the aliquoting of a fluid, which forms the basis for highly multiplexed nucleic acid-based analysis methods, digital PCR applications or single-cell analyses. The literature has already presented a multitude of approaches based on various mechanisms for aliquoting of a fluid. It is possible here to distinguish between droplet-based approaches and those based on the use of a microfluidic aliquoting structure with a multitude of compartments. In the case of approaches of the first kind, a monodisperse emulsion of droplets in a second liquid immiscible phase is produced and stabilized by using suitable interface-active substances, also called surfactants. This fluidically generates the individual reaction compartments, which can make it difficult to achieve defined pre-storage of reagents in the compartments. In the case of approaches of the second kind, the aliquoting, by contrast, is effected in a microfluidic structure, wherein the aliquots, i.e. the portions, are produced in well-defined compartments. It is possible here for target-specific reagents to be pre-stored in the individual compartments, in order to enable highly multiplexed analyses. Furthermore, these approaches have the advantage that the aliquots are localized at defined positions, which permits easier evaluation.

However, the solutions known to date for microfluidic aliquoting are subject to certain restrictions or place specific demands on the device or the method for operation of the device, such that these cannot directly be mapped onto a fully automated lab-on-a-chip system. Some solutions, for instance, require manual pipetting steps. Other solutions require, for complete filling of the cavities, centrifuging at right angles to the plane of the cavity or centrifuging in the plane of the cavity. Although centrifuging can achieve removal of air trapped in the cavities, centrifuging simultaneously constitutes a significant challenge to a lab-on-a-chip system. Moreover, in the case of a centrifugation in the plane of the cavity, the maximum achievable cavity density is reduced owing to the fluid channels required. Other solutions again are based on the gas permeability of the substrate, in order to be able to displace air trapped in the cavities. The solution described in U.S. Pat. No. 9,150,913 B2 utilizes, for example, the elasticity of the substrate. However, many polymers that permit inexpensive manufacture of microfluidic chips in high-throughput methods such as injection molding usually do not have adequate gas permeability or elasticity. The solution presented in U.S. Pat. No. 8,895,295 B2 requires evacuating of the cavities. Lab-on-a-chip systems can be manufactured inexpensively from polymers, for example PC, PP, PE, COP, COC or PMMA. However, some polymers in untreated form have hydrophobic surface characteristics. For wetting of hydrophobic surfaces with aqueous solutions, additional interfacial energy should be supplied to the system composed of fluid and the solid state. The capillary forces present therefore counter complete filling of the microfluidic structure and correspond to a capillary pressure that prevents spontaneous advancing of the fluid meniscus. It is only the application of a sufficient external pressure that can overcompensate for the capillary pressure present, such that advancing of the fluid meniscus can be brought about. However, for pressure-driven wetting of hydrophobic surfaces in particular with aqueous solutions, a suitable design of the geometry of the microfluidic structures is required to achieve complete filling of the structures and prevent unwanted trapping of air.

SUMMARY

Against this background, with the approach presented here, a method of aliquoting a sample liquid using a sealing liquid in a microfluidic device, a device that uses this method, a method of producing such a device and a microfluidic system are presented. The measures listed in the dependent claims enable advantageous developments and improvements of the device according to the disclosure.

The approach presented here is based on the finding that cavities of a microfluidic device can be filled completely and reliably through suitable design of a cavity geometry depending on a contact angle or the wetting characteristics of a sample liquid and on a geometry of an interface that forms at the sample liquid. In this way, it is possible to dispense with evacuating the cavities or initial filling with a gas soluble in the sample liquid or using a gas-permeable substrate or centrifuging at right angles to a plane of the cavity. Furthermore, the approach presented here enables subsequent layering of the sample liquid with a sealing liquid; more particularly, these two steps can be performed in a fully automated manner, so that no manual pipetting steps are required. Moreover, such a device is easily integratable into a microfluidic platform and producible inexpensively.

With regard to the performance of detection reactions in the cavities, for example, control of the sample liquid temperature may be required, for instance for the performance of a polymerase chain reaction, PCR for short. However, gas solubility in liquids generally decreases with rising temperature. This can lead to formation of gas bubbles when the sample liquid and the sealing liquid are heated, which can impair microfluidic sealing and hence aliquoting. In order to solve this problem, it is possible, for example, to work with degassed liquids. However, additional precautions generally have to be taken for pre-storage of degassed liquids over a prolonged period of time, in order to prevent unwanted dissolution of gases in the fluids during the storage. Therefore, the approach presented here optionally enables efficient removal of gas bubbles or on-chip degassing of liquids, such that even incompletely degassed liquids are usable. In particular, it is possible by means of the approach presented here to assure controlled formation of gas bubbles at well-defined sites, such that unwanted formation of gas bubbles at the cavities can be significantly reduced.

With regard to the performance of highly multiplexed detection reactions in the cavities, especially of different, independent reactions in the individual aliquots of the sample liquid, pre-storage of reagents in the cavities may be necessary. However, during the filling of the cavities that form an array structure, for example, there can be entrainment of the reagents pre-stored in the cavities. Entrainment of pre-stored reagents is of major significance for the correct functionality of the cavities, since it can lead to false positive or false negative results. The approach presented here can significantly reduce such entrainment.

The use of a sealing liquid and the exploiting of the different wetting characteristics of sample liquid and sealing liquid can thus achieve thermally stable, especially fully automated, aliquoting of the sample liquid. Another significant factor is that the sample liquid and sealing liquid have zero or only slight miscibility with one another. For aliquoting, the microfluidic device has a chamber having specially shaped cavities. The shape of the cavities is such that some of the sample liquid remains in the cavities after the sealing liquid has been introduced into the chamber. It is possible to ensure that the sample liquid remains in the cavities by the different wetting characteristics of the sample liquid and sealing liquid, and the shape of the biphasic interface that forms between the two liquids and the substrate surface.

By suitable design, it is possible to ensure reliable and complete filling of the cavities. In an advantageous embodiment, the cavities have hydrophilic surface characteristics, such that the cavities are filled with assistance by capillary forces. This may also permit filling of cavities having a relatively high aspect ratio.

The volume of the aliquots can be fixed via the structural geometry and the contact angle of the sealing liquid. The method is especially suitable for small cavities having volumes of less than 10 μL, since the large surface-to-volume ratio here means that the biphasic interface can be efficiently stabilized by the surface energies that occur. This permits finding of a suitable process window for the flow rate that leads to only a slight variation in volume of the aliquots.

By optional reagent pre-storage in the cavities, it is possible to perform mutually independent reactions in the individual aliquots. It is thus possible to perform, for instance, highly multiplexed applications that permit study of a sample with regard to a multitude of different targets. More particularly, for instance by addition of a suitable additive or embedding of the pre-stored reagents in an additive, it is possible to sufficiently prevent entrainment of the pre-stored reagents during the filling and sealing.

In a further embodiment, efficient removal of gas bubbles can assure the thermal stability of the construction, for example in the performance of a polymerase chain reaction, without requiring fully degassed liquids for the purpose. More particularly, it is thus possible to prevent formation of gas bubbles from influencing the biphasic interface between the sample liquid and the sealing liquid or evaporation of the sample liquid out of the cavities into gas bubbles and hence loss from the cavities.

A suitable design of the geometry of the microfluidic structures permits complete filling thereof with the sample liquid or else provision of a more general microfluidic functionality based on the capillary upper surface or interface that forms on the fluid introduced or between multiple fluids introduced. However, an analytical description of the capillary interfaces that form in microfluidic structures is possible in individual cases at best, and the calculation of general capillary interfaces in an arbitrary number of microfluidic geometries by means of numerical methods can be very computation-intensive.

Within the scope of the approach presented here, therefore, a calculation method for efficient calculation of capillary interfaces is also described, in order to be able to suitably design microfluidic structures with regard to a defined microfluidic functionality. This method permits, by definition of contact angles present and a class of test structures with suitable parametrization, ascertaining of a suitable range of values for the parameters in order to achieve a desired microfluidic functionality, for instance complete filling and defined layering with a second fluid.

Examples of microfluidic functionalities are, for instance, complete filling of the cavities or controlled partial displacement of fluids from the cavities. As shown hereinafter, the calculation method may be used, for instance, in order to suitably design a microfluidic cavity array structure such that aliquoting of a fluid between a multitude of cavities can be achieved. The central step of the calculation method is based on a geometric description of the advancing liquid meniscus by circle segments of different curvature that form a fixed angle with the boundary structure. The model can be used to derive conditions on the geometry of the structure that ensure the desired microfluidic functionality, for instance complete filling up to a particular defined contact angle.

A design of microfluidic structures is enabled before complex experimental evaluation. In this way, it is possible to significantly reduce the development work required for the provision and assurance of the desired functionality of a microfluidic structure. More particularly, it is first possible to evaluate a multitude of test structures by calculation before more complex manufacture and experimental evaluation.

Moreover, it is thus possible to derive conditions that can be fulfilled by a region of the parameter space after complete parametrization of the test structures. After the identification of this region, the region can be used as a starting point in order to suitably design a microfluidic structure under possible additional defined boundary conditions.

The calculation method is especially suitable for the design of structures having surfaces that are not wetted by the fluid, i.e. in which there is a large contact angle. Thus, for the provision of a given microfluidic functionality in a given substrate, it may be possible to find a suitable geometry of the microfluidic structure without requiring chemical surface modification of the substrate, i.e. adjustment of the wetting characteristics. Conversely, for the implementation of a given microfluidic functionality, it is also possible to make use of substrates having less suitable surface properties, since these can possibly nevertheless provide a given microfluidic functionality through suitable design of the microfluidic structure.

The approach presented here provides a method of aliquoting a sample liquid using a sealing liquid in a microfluidic device, wherein the sample liquid and sealing liquid have different wetting characteristics and can be associated or are combinable with one another to form a biphasic system composed of two phases separated from one another by an interface, wherein the microfluidic device has a chamber with at least one inlet channel for introduction of the sample liquid and the sealing liquid and a multitude of cavities fillable via the inlet channel, wherein the inlet channel and the cavities have a geometry defined depending on the respective wetting characteristics of the sample liquid and the sealing liquid, wherein the method comprises the following steps:

introducing the sample liquid, wherein the meniscus of the sample liquid is suitably, for example concavely, shaped by the defined geometry and the contact angle present in the sample liquid in order to fill the cavities with the sample liquid; and introducing the sealing liquid after the sample liquid has been introduced, wherein the meniscus of the sealing liquid, by virtue of the contact angle present in the sealing liquid, which is in particular greater than the contact angle of the sample liquid, and the defined geometry, is suitably shaped, for example is convexly shaped, in order to blanket the filled cavities with the sealing liquid.

Aliquoting can be understood to mean division or portioning of a total amount of a sample into multiple portions, also called aliquots or aliquot portions. A sample liquid may be understood to mean, for example, a body fluid, a PCR master mix or a cell suspension. The sealing liquid may, for example, be mineral oil, paraffin oil or silicone oil, a silicone prepolymer or a fluorinated oil, for example Fomblin, Fluorinert FC-40/FC-70.

Wetting characteristics may be understood to mean characteristics of liquids on contact with a solid-state surface. According to the nature of the liquid and the material and properties of the solid-state surface, the liquid can wet the solid-state surface to a greater or lesser degree. The wetting characteristics can thus be characterized by a contact angle, also called wetting angle. A contact angle may be understood to mean an angle that an amount of liquid forms relative to a solid-state surface. The size of the contact angle between amount of liquid and solid-state surface depends on the interaction between the substances at the contact surface: the smaller the interaction, the greater the contact angle, and vice versa.

A cavity may be understood to mean a depression in a substrate. The cavities may be arranged, for example, in an array structure with multiple columns or lines. The cavities may be fluidically connected to one another via the inlet channel. According to the arrangement of the cavities, the cavities, on introduction of a liquid via the inlet channel, may be filled simultaneously or successively with the liquid. For example, cavities belonging to one line may be filled simultaneously, while cavities belonging to one column may be filled successively.

A defined geometry may be understood to mean, for example, a defined height, a defined width, a defined length, a defined volume, a defined radius of curvature or another geometric parameter of the inlet channel and especially of the cavities. The geometry may especially be defined by a calculation method described in detail hereinafter as a function of the respective wetting characteristics of the liquids to be introduced and of the respective material of the inlet channel and the cavities.

A meniscus may be understood to mean the curvature of a surface of a liquid, wherein the curvature originates from an interaction between the liquid and a surface of an adjoining wall. A concave meniscus may be understood to mean a surface of the liquid that curves inward. A convex meniscus may be understood to mean a surface of the liquid that curves outward.

By virtue of the meniscus of the sample liquid being suitable as a result of the contact angle present, for example in concave form, it is possible to avoid trapped air on inflow of the sample liquid into the cavities. By virtue of the meniscus of the sealing liquid that forms in convex form, for example, it is possible to achieve the effect, by contrast, that the interface that forms in the cavities between the sample liquid and the sealing liquid is curved in the direction of a respective base of the cavities. It is thus possible to prevent the portions of the sample liquid present in the cavities from being displaced for the most part by the inflowing sealing liquid. This can also effectively prevent escape of the sample liquid from the cavities.

In one embodiment, in an introduction step, at least one reagent and/or one additive can be introduced into the cavities prior to the introduction of the sample liquid. A reagent may be understood to mean, for example, a primer or a probe, for instance for detection of specific DNA sequences or other target molecules in the sample liquid. An additive may be understood to mean an auxiliary or addition, for example polyethylene glycol, xanthan, trehalose, agarose, gelatin, paraffin or a combination of two or more of the substances mentioned. By virtue of this embodiment, various detection reactions can be performed specifically and reproducibly in different portions of the sample liquid.

For example, in the introduction step, the reagent and/or the additive can be dried in the cavities. This enables stable incorporation of the reagent or the additive over a long period. This can also prevent entrainment of the reagent or of the additive on filling of the cavities.

In a further embodiment, in the introduction step, the reagent can be dried in a first drying step and the additive can be dried in a second drying step that follows the first drying step. This can reduce entrainment of the reagent to a minimum.

Furthermore, the method may comprise a step of adjusting the temperature of the sample liquid to a reaction temperature. The chamber may be put here in an oblique position and/or set in a rotating motion. A reaction temperature may be understood to mean a given temperature at which particular reactions take place in the sample liquid, for example a polymerase chain reaction or a detection reaction for detection of particular molecules in the sample liquid. This can ensure that gas bubbles that can form on heating of the sample liquid ascend rapidly and are removed from the cavities.

In a further embodiment, in a heating step, a liquid-guiding section of the microfluidic device upstream and/or downstream of the cavities can be brought to a degassing temperature for degassing of the sample liquid and/or of the sealing liquid. A liquid-guiding section may be understood to mean a section of the device fluidically coupled to the cavities, for example in the form of a further chamber or a channel. For example, the liquid-guiding section may comprise a temperature-controllable deaeration chamber. This can efficiently prevent the formation of gas bubbles in the cavities.

It is also advantageous when, in the step of introducing the sealing liquid, the sealing liquid is introduced at a temperature at least as high as a temperature of a liquid present in the cavities. This can prevent evaporation of the sample liquid in the cavities.

The approach presented here also provides a microfluidic device for aliquoting of a sample liquid using a sealing liquid, wherein the sample liquid and the sealing liquid have different wetting characteristics and are combinable with one another to form a biphasic system composed of two phases separated from one another by an interface, wherein the microfluidic device has the following features:

a chamber having at least one inlet channel for introducing the sample liquid and the sealing liquid and a multitude of cavities fillable via the inlet channel, wherein the inlet channel and the cavities have a geometry defined depending on the respective wetting characteristics of the sample liquid and the sealing liquid.

The microfluidic device may be implemented, for example, as a lab-on-a-chip unit made of a suitable substrate, for instance PC, PP, PE, COP, COC or PMMA. As a result, the device is producible inexpensively and in high numbers.

In one embodiment, the cavities may be rounded. For example, a respective outer edge of the cavities may be shaped with a suitable rounding. Additionally or alternatively, for instance, it is also possible for an inner edge to be rounded in a suitable manner at the respective base of the cavities. As a result, the meniscus and the flow characteristics of liquids introduced may be optimized with regard to maximum completeness of bubble-free filling of the cavities with a low level of complexity.

It is particularly advantageous when a respective width of the cavities is greater than a maximum extent of a meniscus of the sample liquid. A maximum extent may be understood to mean, for example, a maximum width that the meniscus can assume on inflow into a cavity. By virtue of this embodiment, it is possible to ensure that the meniscus of the sample liquid on inflow into a cavity comes into contact first with the flow-facing side flank thereof and then with the base thereof, such that any gas volume present in the cavity is displaced to the maximum possible degree by the meniscus of the sample liquid. It is thus possible to avoid trapped air in the cavities.

For example, the geometry may be defined by the following conditions:

(I) $2r_2+w>c+r$ (II) $r_2>c+r-s-r_1-d$, with $r_1$: rounding radius at an outer edge of the cavities, $r_2$: rounding radius at a bottom edge of the cavities, w: inner width of a base of the cavities, c+r: maximum extent of the meniscus of the sample liquid, s: height of the inlet channel, d: height of a sidewall of the cavities.

It is thus possible to define the geometry with comparatively low calculation complexity.

According to the embodiment, the cavities may have at least partly hydrophilic surface characteristics and/or different geometries and/or different volumes. By virtue of the hydrophilic surface characteristics, it is possible to achieve better fillability of cavities with aqueous media. In this way, in particular, the filling of cavities with a larger aspect ratio of cavity depth to cavity width becomes possible. In addition, by virtue of different cavity geometries, it is possible to provide different reaction volumes.

The microfluidic device may, in a further embodiment, have a deaeration chamber fluidically coupled to the chamber for deaeration of the microfluidic device and a temperature controller for heating the deaeration chamber and for degassing the sample liquid and/or the sealing liquid. This embodiment enables particularly efficient, precisely controllable degassing of liquids introduced outside the cavities.

The approach presented here additionally provides a process for producing a microfluidic device according to any of the preceding embodiments, wherein the method comprises the following steps:

reading in wetting information representative of the wetting characteristics of the sample liquid and the wetting characteristics of the sealing liquid;

defining the geometry of the inlet channel and the cavities using the wetting information; and forming the chamber with the inlet channel and the cavities in accordance with the defined geometry, in order to produce the microfluidic device.

For example, the device, in the forming step, may be produced in a suitable additive manufacturing method, for instance 3D printing or stereolithography, a subtractive manufacturing method, such as ultrashort-pulse laser ablation or micromachining, or a high-throughput method, for instance injection molding or thermoforming, from a polymer. This enables near-net-shape, rapid and inexpensive manufacture of the device in high numbers.

The approach presented here further provides a microfluidic system having the following features:

a microfluidic device according to any of the preceding embodiments;

a pump unit for pumping liquids through the chamber of the microfluidic device; and a controller for actuating the pump unit.

A controller may be understood to mean an electrical device that processes sensor signals and emits control and/or data signals depending thereon. The controller may have an interface in the form of hardware and/or software. In the form of hardware, the interfaces may, for example, be part of what is called a system ASIC that includes a wide variety of different functions of the controller. However, it is also possible that the interfaces are separate, integrated circuits or consist at least partly of discrete components. In the form of software, the interfaces may be software modules present, for example, on a microcontroller alongside other software modules.

This enables fully automated aliquoting of the sample liquid.

BRIEF DESCRIPTION OF THE DRAWINGS

Working examples of the disclosure are shown in the drawings and elucidated in detail in the description that follows. The figures show.

DETAILED DESCRIPTION

Figure 1:
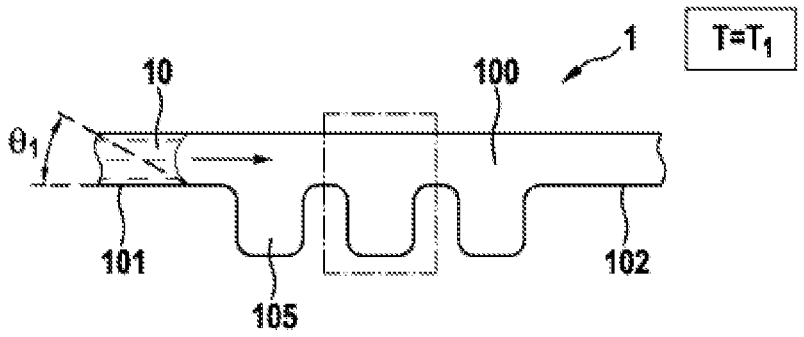
FIGS. 1*a-c* schematic diagrams of a microfluidic device in one working example.
Figure 1:
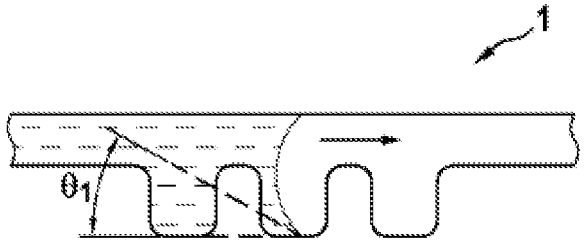
Figure 1:
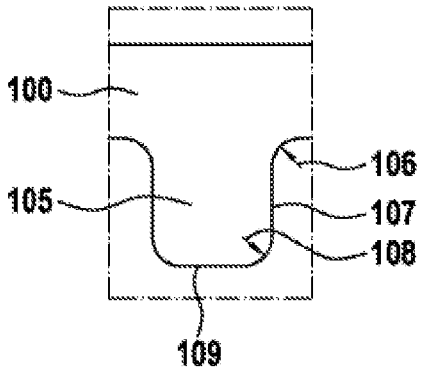

In the description of advantageous working examples of the present disclosure that follows, similar or identical reference signs are used for the elements having a similar effect that are shown in the different figures, dispensing with repeated description of these elements.

FIGS. 1*a* to 1*c* show schematic diagrams of a microfluidic device 1 in one working example. The device comprises a chamber 100 having at least one inlet channel 101 and at least one outlet channel 102 for introduction and discharge of liquids, and a multitude of cavities 105 fillable via the inlet channel 101. A cross section of the chamber 100 is shaped with a geometry defined by the respective wetting characteristics of the liquids introduced. FIGS. 1*a* and 1*b* show the propagation of a sample liquid 10 on introduction into the chamber 100. It can be seen how the cavities 105 are filled completely owing to the concave meniscus of the sample liquid 10 which is curved counter to a flow direction. Subsequently, the cavities 105 filled with the sample liquid 10 are layered with a sealing liquid 20, as shown in FIGS. 2*a* to 2*c*.

Shown by way of example in FIGS. 1*a* to 1*c* is a cross section through a section of a cavity array structure in a given substrate, for instance made of PC, PP, PE, COP, COC, PMMA, float glass, anodically bondable glass, photostructurable glass, silicon, metal or a combination of these materials and/or with modified surface properties, for instance with a surface having high biocompatibility. The sample liquid 10 forms a contact angle $\theta_1$ with the substrate that permits complete filling of the cavities 105 with the sample liquid 10.

After the structure has been filled with the sample liquid 10, in a second step, the filled cavities 105 are layered with the sealing liquid having zero or only low miscibility with the sample liquid 10, such that a stable microfluidic interface is formed between the liquids. The properties of the sealing liquid are such that it has a contact angle $\theta_2$ with respect to the substrate surface of the filled cavity array structure which is greater than the contact angle $\theta_1$ to a sufficient degree that a portion of the sample liquid 10 remains in the cavities 105, as apparent from FIGS. 2*a* to 2*c*. The cavities 105 can be suitably designed, for instance, by a calculation method described hereinafter for geometric design of microfluidic structures. In this way, it is possible to achieve well-defined aliquoting of the sample liquid 10 in the cavities 105.

In one working example, the cavities 105 have roundings 106, 108 on their flanks 107. By means of the rounding 108 adjoining a base 109 of the cavities 105, it is possible to prevent trapping of air in the cavities 105. This is especially relevant if the aim is for the cavities 105 to become filled with a non-wetting liquid having a large contact angle with respect to the substrate. Suitable dimensions of the roundings 106, 108 are likewise found, for example, in the calculation method just mentioned. By means of the rounding 106 adjoining the chamber 100, it is possible to prevent or at least significantly reduce unwanted pinning of the liquid meniscus, which would occur in the case of abrupt widening of the chamber 100. This pinning is disadvantageous for complete filling of the cavities 105 since it can lead to abrupt changes in the capillary pressure present and hence also to relatively large variations in the flow rate during the filling process. These variations can have an adverse effect on the filling characteristics.

In a particularly advantageous working example, the cavities 105 have hydrophilic surface properties that permit capillary-assisted filling. Owing to the small contact angle $\theta_1$ that the sample liquid 10, generally an aqueous phase, forms with the substrate in this case, it is still possible to fill even cavities having a relatively high aspect ratio completely with an aqueous phase. This is advantageous in turn since a relatively small contact angle $\theta_2$ of the sealing liquid is then already sufficient for a portion of the sample liquid 10 not to be displaced from the cavities 105. This allows the use of various fluids as sealing liquid.

Figure 2:
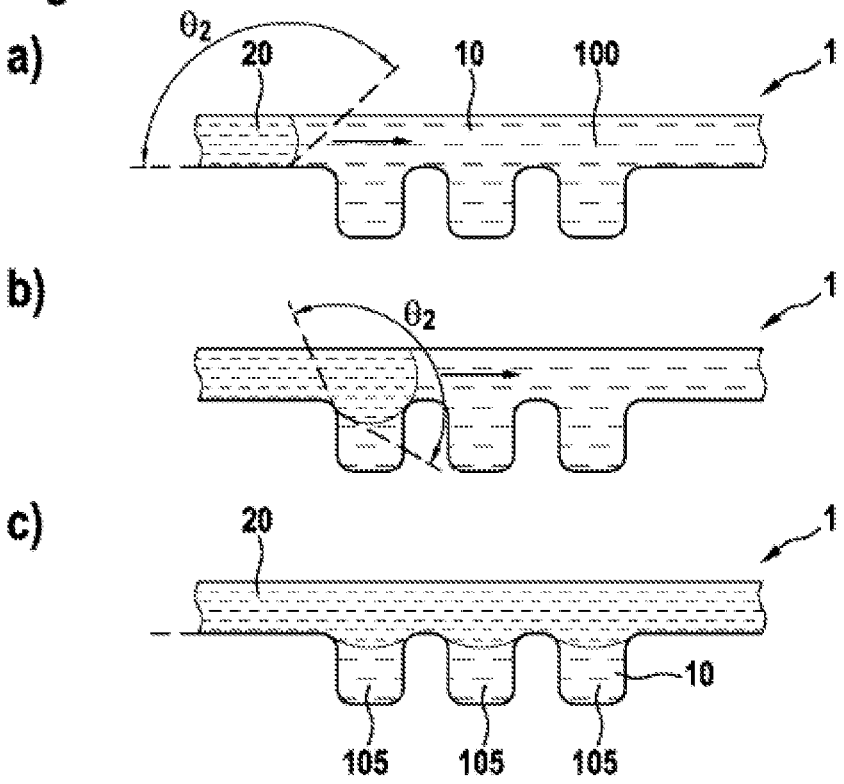
FIGS. 2*a-c* schematic diagrams of a microfluidic device from FIG. 1 during a layering process.

FIGS. 2*a* to 2*c* show schematic diagrams of a microfluidic device 1 from FIG. 1 during a layering process with the sealing liquid 20. It can be seen that the sealing liquid 20, by contrast with the sample liquid 10, has a convex meniscus, i.e. curved in flow direction, defined by the contact angle $\theta_2$. As a result, an interface forms between the liquids superposed in the cavities 105, curved in the direction of a respective base of the cavities 105.

Figure 3:
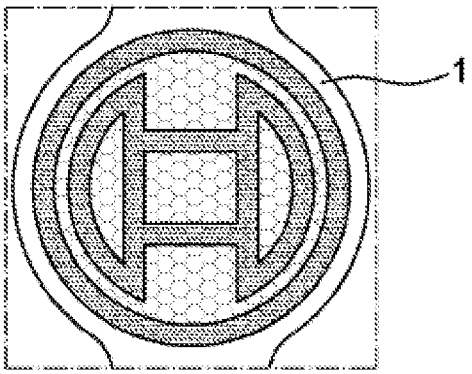
FIG. 3 a schematic diagram of a microfluidic device in one working example in top view.

FIG. 3 shows a schematic diagram of a microfluidic device in a working example in top view. What is shown is a microscope image of a cavity array structure that has been filled first with a dark-colored aqueous solution as sample solution and then with a colorless liquid, shown in a light color here, as sealing liquid, which is miscible with the aqueous phase only to a small degree, if at all, such that the dark-colored liquid remains in the cavities and hence aliquoting of the dark-colored liquid is achieved. Depending on the geometric shape of the cavities, the volume of the individual aliquots of the first liquids can be adjusted.

The cavity array structure has, by way of example, two different cavity geometries that correspond to two different volumes of the aliquots. The color contrast present in the microscope image results from the different volumes of the aliquots. By suitable arrangement of the two different cavity shapes, by way of example, the pattern of a double-T anchor in top view was replicated.

Figure 4:
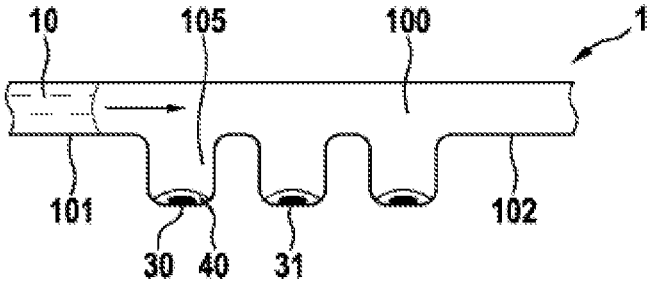
FIGS. 4*a-c* schematic diagrams of a microfluidic device from FIG. 1 with incorporated reagents.
Figure 4:
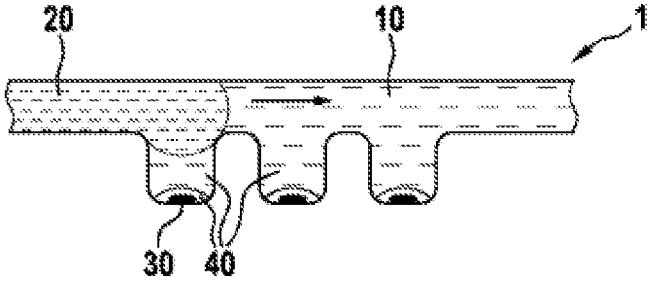
Figure 4:
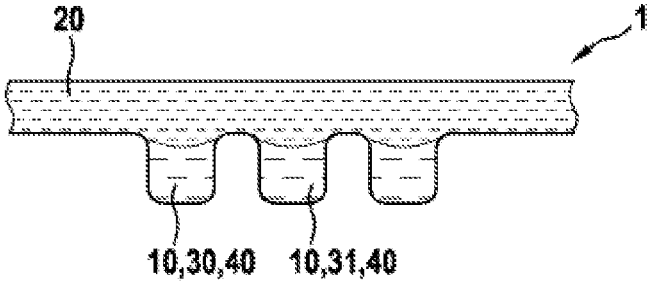

FIGS. 4*a* to 4*c* show schematic diagrams of a microfluidic device 1 from FIG. 1 with reagents 30, 31 incorporated in the cavities 105. These are, for instance, primers and probes which, after performance of a (quantitative) polymerase chain reaction, allow the conclusion of the presence of target-specific DNA base sequences in the sample liquid 10. This geometric multiplexing allows analysis of the sample liquid 10, depending on the number of cavities, for the presence of a multitude of different target molecules. For example, it is also possible in this way to pre-store DNA template molecules in order to perform a multitude of defined standard amplification reactions as references. By comparison of fluorescence signals of the amplification reactions in the aliquots of the sample liquid 10 with signals of standard amplification reactions, it is possible to conclude the starting amounts of the targets in the sample liquid 10.

In a further working example, the reagents 30, 31 are incorporated in an additive 40 that prevents unwanted goinginto-solution and entraining of the pre-stored reagents 30, 31 during the filling of the cavities 105 with the sample liquid 10 before layering of the aliquots with the sealing liquid 20. The reagents 30, 31 in the additive 40 are incorporated, for instance, by defined spotting and drying of an aqueous solution of the reagents 30, 31 and the additive 40.

In a further working example, in a first step, the reagents 30, 31 are dried in the cavities 105 and then, in a second step which is executed after the first step, the additive 40 is spotted and dried. Such successive drying enables a significant reduction of the entrainment of the reagents 30, 31.

In one working example, the second step is executed repeatedly in succession. In this way, it is possible to achieve particularly stable incorporation of the reagents 30, 31 in the additive 40.

By addition of a suitable additive and the choice of a suitable process regime, it is possible to prevent unwanted entrainment. More particularly, the time between filling and sealing should not be too long. For example, an additive of sparing or zero water solubility that brings about release of the pre-stored reagents within the periods characteristic of the filling process only at elevated temperature is used.

Figure 5:
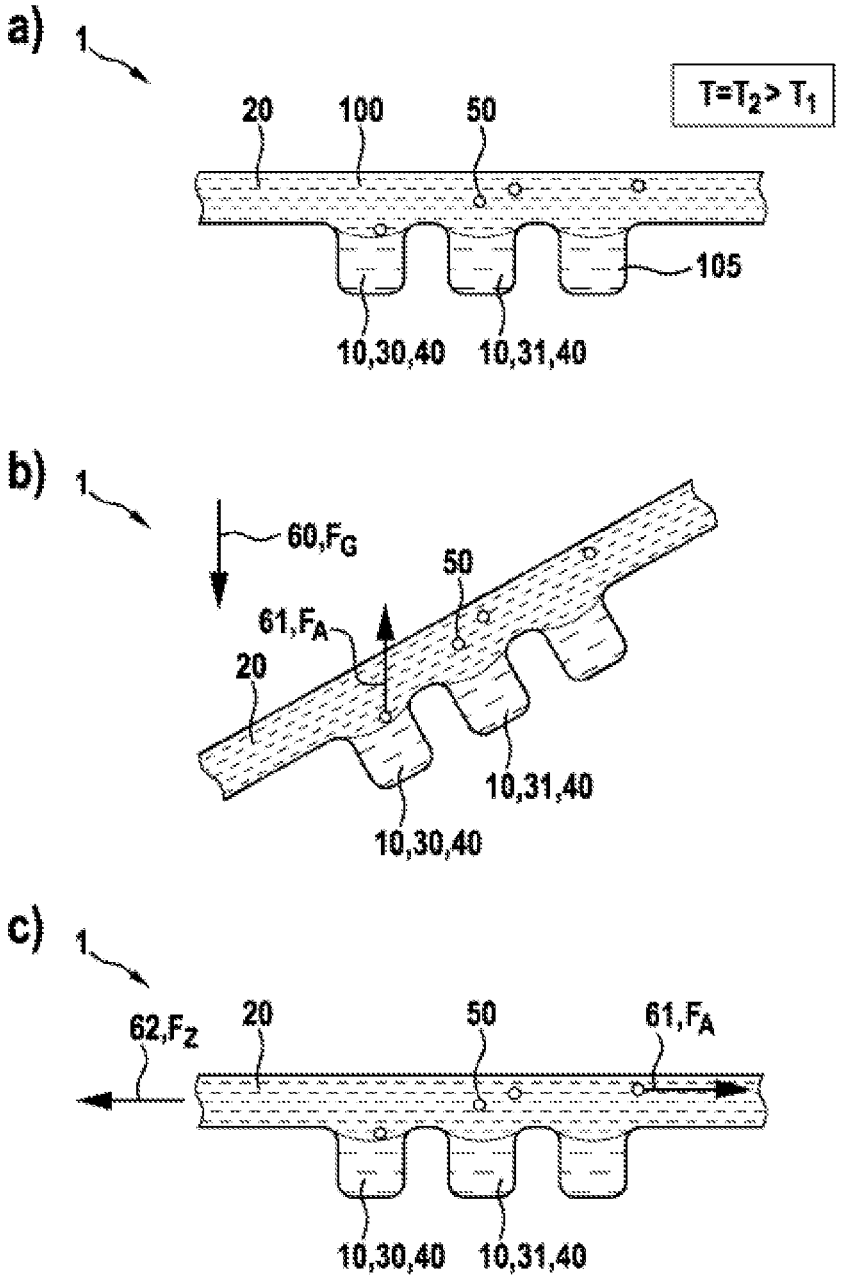
FIGS. 5*a-c* schematic diagrams of a microfluidic device from FIG. 1 during a degassing process.

FIGS. 5*a* to 5*c* show schematic diagrams of a microfluidic device 1 from FIG. 1 during a degassing process. The temperature of the sample liquid 10 is adjusted here to a reaction temperature $T_2$, which is above an ambient temperature $T_1$ of the device 1 here. By suitable control of the temperature of the sample liquid 10, it is possible, for example, to perform multiple independent polymerase chain reactions in the aliquots of the sample liquid 10. Since the gas solubility of liquids is temperature-dependent and usually decreases with rising temperature, it is generally necessary in the case of use of incompletely degassed liquids to remove gas bubbles 50 that precipitate out from the aliquots of the sample liquid 10 in a suitable manner, for instance in order to prevent unwanted evaporation of the sample liquid 10 into the gas bubbles 50, which can lead to a loss of sample liquid 10 from the cavities 105.

For avoidance of gas bubbles 50, for example, the entire structure of the device 1 or at least the chamber 100 is in a tilted alignment relative to the direction of action of a gravitational force 60, as shown in FIG. 5*b*. For instance, a resulting buoyancy force 61 acting on the gas bubbles 50 and in particular a force component at right angles to the plane of the cavities 105 may be utilized in order to remove the gas bubbles 50 that form from the region of the cavities 105.

In a further working example, the device 1 is additionally or alternatively set in a rotating motion, such that the buoyancy force 61 resulting from a centrifugal force 62 makes it possible to conduct the gas bubbles 50 away. This is shown in FIG. 5*c*.

It is particularly advantageous when the sealing liquid has a low viscosity, such that precipitating gas bubbles have a low fluidic resistance and high mobility in the liquid, in order to be able to be efficiently removed.

Optionally, the device 1 has a bubble formation unit designed to bring about condensation of precipitating gases at well-defined sites. In this way, it is possible to prevent bubble formation in the region of the cavities 105.

Figure 6:
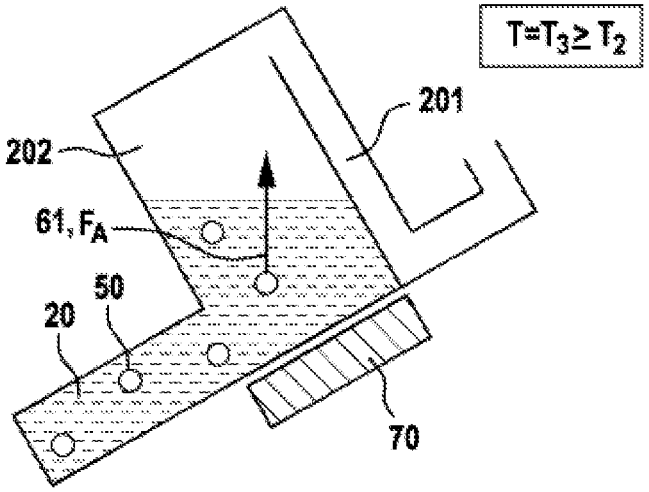
FIG. 6 a schematic diagram of a deaeration chamber in one working example.

FIG. 6 shows a schematic diagram of a deaeration chamber 202 in one working example. The deaeration chamber 202 is fluidically connected to the chamber in which the cavities are present, also called cavity array chamber, and comprises a deaeration channel 201 coupled to a surrounding atmosphere. By means of a heat source 70, the deaeration chamber 202 is heatable to a degassing temperature $T_3$ which is especially greater than or equal to the reaction temperature $T_2$. In this way, degassing of liquids, especially of the sealing liquid 20, in the deaeration chamber 202 is achieved, such that unwanted bubble formation in the cavity array chamber is avoided.

In one working example, the sealing liquid 20 in the deaeration chamber 202 is degassed before being introduced into the cavity array chamber.

In a further working example, the sealing liquid 20 is brought to a temperature greater than or equal to the temperature of the sample liquid present in the cavities. In this way, it is possible to prevent evaporation of the sample liquid and condensation on the top side of the structure.

Illustrative dimensions of the device 1 are listed hereinafter:

- thickness of the polymer substrates: 0.1 mm to 10 mm, preferably 1 mm to 3 mm;
- channel cross sections: $10\times10\ \mu m^2$ to $3\times3\ mm^2$, preferably $100\times100\ \mu m^2$ to $1\times1\ mm^2$;
- dimensions of the chamber: $1\times1\times0.3\ mm^3$ to $100\times100\times10\ mm^3$, preferably $3\times3\times1\ mm^3$ to $30\times30\times3\ mm^3$;
- lateral dimensions of the overall system: $10\times10\ mm^2$ to $200\times200\ mm^2$, preferably $30\times30\ mm^2$ to $100\times100\ mm^2$;
- number of cavities for (multiplex) digital PCR: 100-1 000 000, preferably 1000-100 000;
- volume of cavities for (multiplex) digital PCR: 1 p1 to 1 μl, preferably 10 pl to 100 μl;
- number of cavities for multiplex (quantitative) PCR: 2-1000, preferably 10-100;
- volume of cavities for multiplex (quantitative) PCR: 10 pl to 10 μl, preferably 100 pl to 1 μl.

There follows a description of a calculation method for design of the geometry of the chamber and the cavities of the microfluidic device described above.

This involves first fixing a class of test structures which is defined by a set of parameters. The characteristics of this class may be such that the test structures present meet existing boundary conditions with regard to the geometry.

In the next step, the microfluidic functionality of the test structures is evaluated by calculation by modeling of the biphasic interface described hereinafter. In the course of this evaluation, adjustment or extension of the parameter space may become necessary, for instance if no entity from the class of the test structures provides the desired microfluidic functionality. According to the model-based (iterative) interpretation of the structure, in the last step of the method, the functionality is evaluated experimentally.

On the basis of the experimental result, it may be the case that a further adjustment or extension of the parameter space that describes the structure geometry is required. This may be the case, for instance, when the real surface properties or the dynamics of the microfluidic filling process lead to contact angles outside the range of tolerance which is limited by an angle e as described in detail hereinafter. Conversely, by means of additional microfluidic elements such as throttles etc., it is possible to control the dynamics of the filling process such that the real (dynamic) contact angle is within the given tolerance range.

Figure 7:
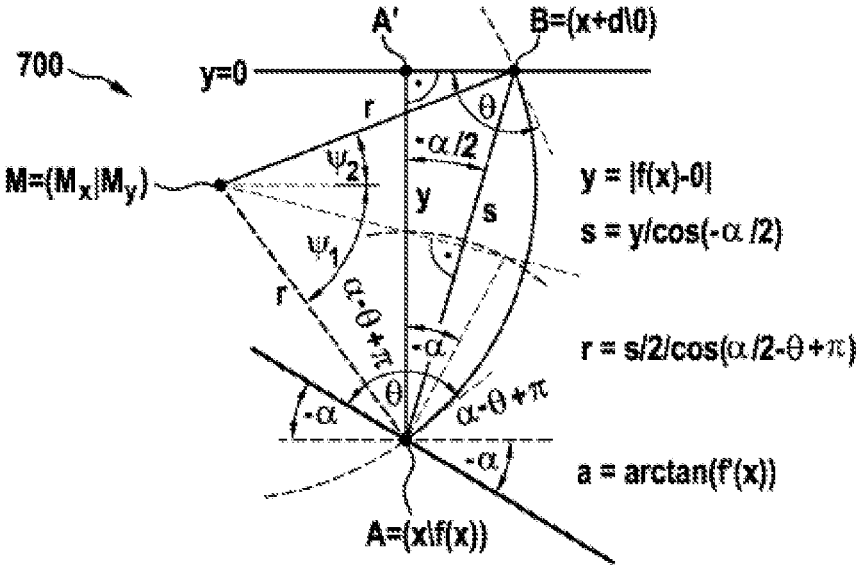
FIG. 7 a schematic diagram of parameters for two-dimensional geometric description of a phase interface in a microfluidic device in one working example.

FIG. 7 shows a schematic diagram 700 of parameters for two-dimensional geometric description of a phase interface in a microfluidic device in one working example. The central step of the method is the two-dimensional geometric description of the phase interface between two fluids that are insoluble or barely soluble in one another, for instance water and air or water and oil, in a boundary structure as the third, solid phase, for instance composed of a polymer such as PC, PP, PE, COP, COC or PMMA, by a circle segment, under the boundary conditions that the tangents of the circle segment and the boundary structure each form a given angle e with one another at the two three-phase points A, B. The modeling of the phase interface by circle segments may be motivated by the surface tension that exists at the phase interface. The capillary pressure that corresponds thereto leads to a constant curvature of the two-dimensional interface (cf. Young-Laplace equation). The simplifying description of the biphasic interface by circle segments is particularly advantageous since it firstly permits efficient analytical calculation of cross sections of capillary interfaces and secondly, for geometries with virtually fixed main planes of curvature, provides a very good approximation to the cross sections of the exact three-dimensional interface that exist within the main planes of curvature (cf. FIGS. 10*a* to 10*i* and FIGS. 11*a* to 11*g*). The specification of an angle θ formed by the tangents to the biphasic meniscus and the boundary structure at the three-phase points A, B can be motivated by the formation of a contact angle that results from the interfacial energies or surface tensions. The specified angle θ thus defines the boundary of a tolerance range within which the real contact angle must lie so that the desired microfluidic functionality is provided. The real contact angle present during the filling process may be subject to certain (small) fluctuations that may be caused, for instance, by dynamic effects without any resultant restriction of the applicability of the method.

FIG. 7 shows the detailed geometric construction of the two-dimensional phase interface in a boundary structure which is planar on one side. The biphasic interface is constructed by a circle segment with center M and radius of curvature r in a channel cross section described by the channel width y and the opening angle −α. Among others, the following coordinates and relationships are shown:

$M=(M_x|M_y)$,
$A=(x|f(x))$,
$B=(x+d|0)$,
$Y=|f(x)-0|$,
$s=y/\cos(-\alpha/2)$
$r=s/2/\cos(\alpha/2-\theta+\pi)$
$\alpha=\arctan(f'(x))$ By exploiting the trigonometric relationships that exist between the parameters involved, it is possible to conclude the radius of curvature as a function of the angles α, θ and the local channel width y:

$$r(\theta, \alpha, y) = \frac{y}{2\cos(-\alpha/2)\cos(\alpha/2-\theta+\pi)}$$

The calculation method described hereinafter is then employed in order to design a microfluidic cavity array structure in such a way that the cavities are completely filled when a liquid wets the inlet and outlet channel present above the cavities. In order to assure the applicability of the method, the dimensions of the microfluidic structure and the flow rate should be chosen such that the shape of the biphasic interface is stabilized by the surface tension and kinetic effects have only a limited influence on the process. It can thus be ensured that the dynamic (wetting) contact angle is within the range of tolerance and does not exceed the angle θ which is used for the design of the structure.

Figure 8:
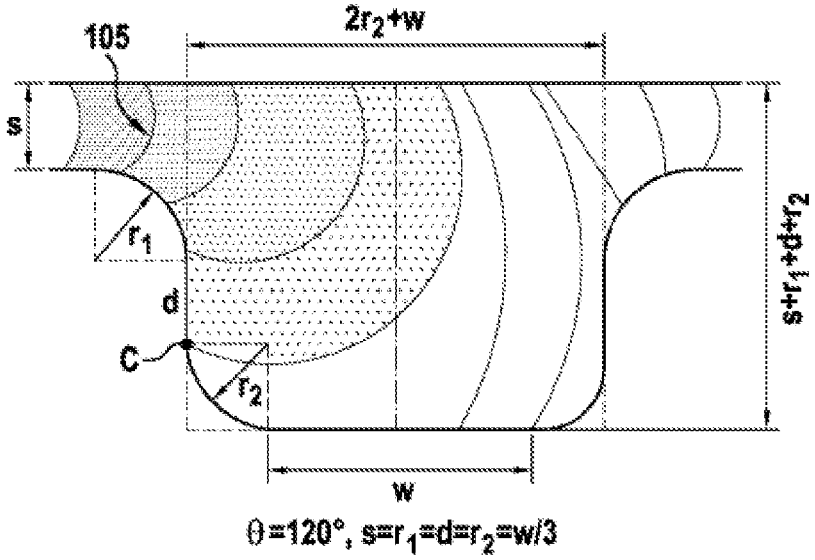
FIG. 8 a schematic cross-sectional diagram of a cavity in one working example.

FIG. 8 shows a schematic cross-sectional diagram of a cavity 105 in a working example. For parametrization of a class of test structures, a two-dimensional channel cross section to be suitably designed is considered with an upper straight boundary and a lower boundary of arbitrary shape. In addition, a two-dimensional channel cross section is considered, which, at least in part, is shaped with mirror symmetry with respect to an axis of symmetry that lies at right angles to the upper straight boundary, in such a way that the cavity 105 is formed. A class of test structures of relevance in respect of this problem may be defined by the following five parameters:

- s as the minimum channel width (without shaping of the cavity),
- $r_1$ as the rounding radius of the top side of the cavity,
- d as the height of the side flank of the cavity,
- $r_2$ as the rounding radius of the bottom side of the cavity and
- w as the inner width of the base of the cavity.

FIG. 8 shows, by way of example, the test structure that results for the choice of parameters $s=r_1=d=r_2=w/3$. Likewise shown is the model-based construction of the biphasic meniscus for various positions of the meniscus and θ=120°.

A crucial factor for the complete wetting of the cavity 105 by a liquid seems to be the condition that the liquid does not come into contact with both flanks of the cavity 105 before the medium initially present in the cavity 105, for instance air, has been displaced from the entire volume that adjoins the base of the cavity 105. The satisfaction of this condition can be decided on the basis of the maximum meniscus tilt that occurs, i.e. a maximum distance t between the three-phase point B and a point A' at the upper boundary, where A' is given by the orthogonal projection of the three-phase point A on the axis defined by the upper, straight boundary of the structure (cf. FIG. 7). The meniscus tilt t thus defined can be determined in the geometry under consideration as $t=y\tan(-\alpha/2)$ (see FIG. 7) and becomes (for $r_2<s+r_1+d$) a maximum at a critical point C that marks the lower conclusion of the (left-hand) vertical (|α|=90°) flank of the cavity 105.

Figure 9:
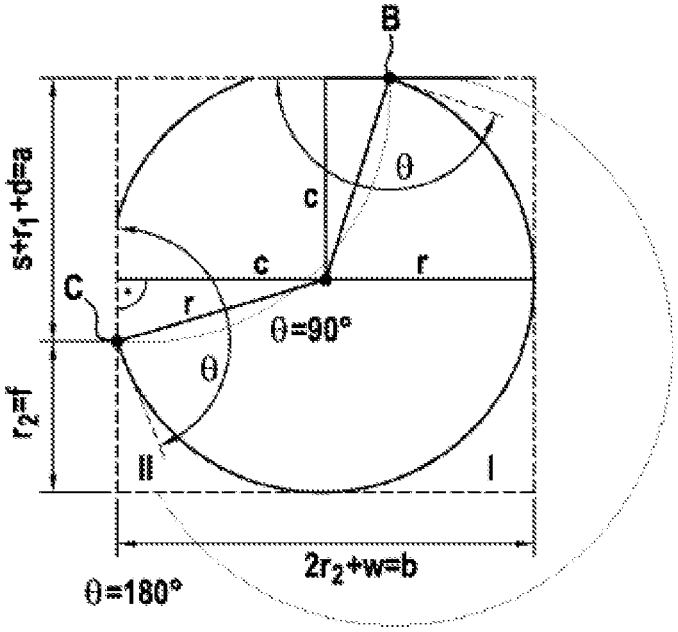
FIG. 9 a schematic diagram of a maximum extent of a meniscus in a cavity in one working example.

FIG. 9 shows a schematic diagram of a maximum extent of a meniscus in a cavity 105 in one working example. FIG. 9 delineates the maximum extent of the meniscus that exists (for $r_2<s+r_1+d$) at the critical point C. The range of relevance for possibly incomplete filling of the cavity 105 is the range of 90°<θ≤180°, i.e.

$$c = r\sin\left(\theta - \frac{\pi}{2}\right) > 0.$$

With regard to the cavity geometry defined above (cf. FIG. 8), the two following sufficient conditions are found for complete filling of the cavity 105:

$$2r_2+w>c+r \quad \text{(I)}$$

$$r_2>f=c+r-\alpha \text{ (regions I and II in FIG. 9)} \quad \text{(II)}$$

With the geometric relationships $c=r\sin(\theta-\pi/2)$, $r=a/\sqrt{2}/\sin(\theta-\pi/4)$ and with $a=s+r_1+d$, the result for θ>90° is the following conditions for complete filling of the cavity 105 under the above criterion:

$$\frac{2r_2+w}{s+r_1+d} > g(\theta) \quad \text{(I)}$$

$$\frac{r_2}{s+r_1+d} > g(\theta)-1, \text{ with } g(\theta) = \frac{\cos(\theta)-1}{\cos(\theta)-\sin(\theta)} \quad \text{(II)}$$

The conditions restrict the space of the geometry parameters to a region in which the structure is filled completely for a maximum angle θ. The aspect ratios $$AR_1 = \frac{2r_2 + w}{s + r_1 + d} \text{ and } AR_2 = \frac{r_2}{s + r_1 + d}$$

can therefore be regarded as characteristic parameters of a cavity geometry with regard to complete filling.

Figure 10:
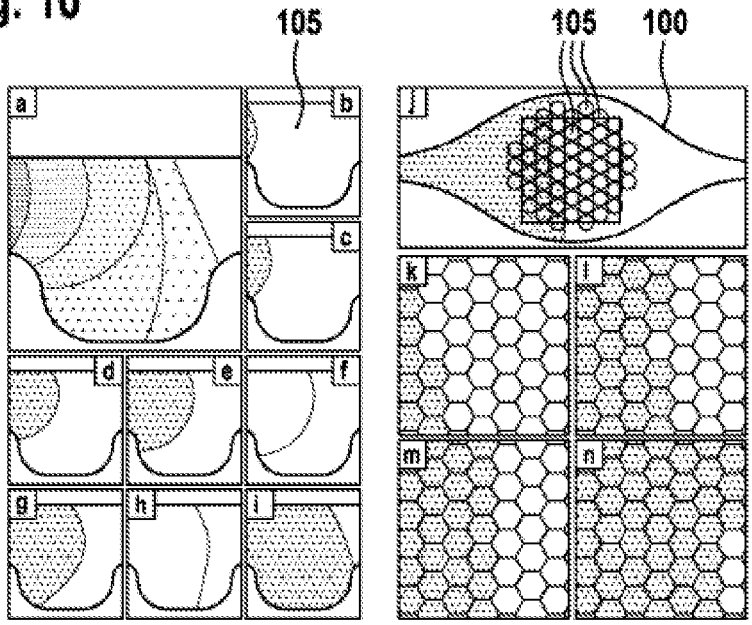
FIG. 10 schematic diagrams of a cavity and a chamber in one working example during a filling process.

FIG. 10 shows schematic diagrams of a cavity 105 and a chamber 100 in one working example during a filling process. What are shown by way of example are measurement results for applicability of the calculation method. For the measurements, various microfluidic test structures have been manufactured in a polycarbonate substrate. Plate a shows biphasic interfaces calculated by the method that result for the specific cavity geometry with the parameter selection s=400 μm, $r_1=r_2$=200 μm, d=0, w=300 μm and an angle θ=110°. Plates b to i show schematics of eight microscope images that were taken during a filling process. The scale bar in plate b corresponds to 200 μm. The microscope images of the microfluidic biphasic interface that forms have a good agreement with the calculated shapes that result from the performance of the method. Plate j shows a schematic of the top view of the chamber 100, here in the form of a cavity array comprising, by way of example, 55 circular cavities 105 in a hexagonal arrangement that have a cross-sectional geometry that satisfies the same aspect ratios as the microfluidic shape shown on the left-hand side of plates a to i. Plates k to n show schematics of four microscope images that were made during the filling of the cavity array structure. The scale bar in plate k corresponds to 500 μm. The field of view of the images in plates k to n is marked by a frame in plate j. The images show complete homogeneous filling of the cavities 105.

Figure 11:
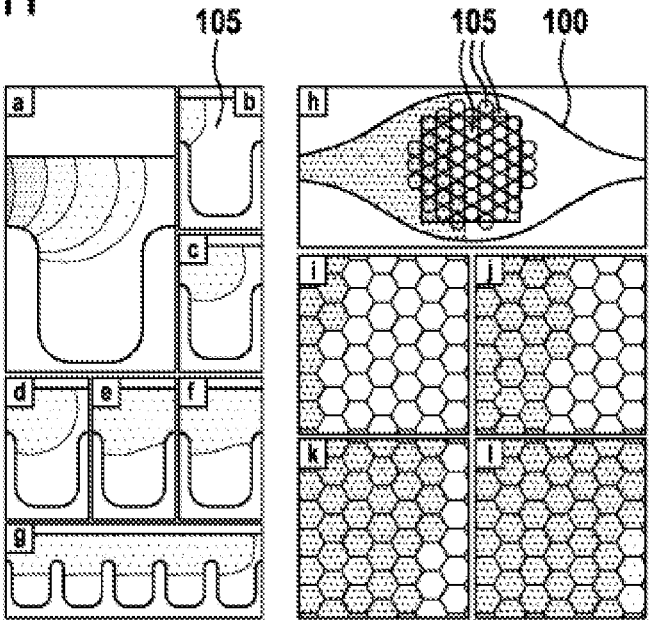
FIG. 11 schematic diagrams of a cavity and a chamber with unsuitable geometry during a filling process.

FIG. 11 shows schematic diagrams of a cavity 105 and a chamber 100 with unsuitable geometry during a filling process. The results shown are obtained for an unsuitable cavity geometry. The corresponding parameters are, by way of example: θ=110°, s=d=200 μm, $r_1=r_2$=w=100 μm. The microscope images of the biphasic interface in plates b to d that were taken during the filling process do show good agreement with the shapes calculated, but complete filling (given existence of a sufficiently large contact angle) does not take place with this cavity geometry since the meniscus spans both flanks of the cavity shape before the air present in the cavity 105 has been displaced completely from the cavity 105. This results in unwanted trapping of air in the cavity 105, which prevents complete filling. Nor is it possible to ensure complete filling of the cavities 105 for the array structure derived from the cavity geometry, as shown by the microscope images in plates i to l. The scale bars correspond to 200 μm in plate b and 500 μm in plates g and i.

In order to evaluate filling characteristics in the course of the calculation method, it is also possible to employ the sufficient conditions derived above, as shown hereinafter for the geometries considered in FIGS. 10 and 11. For an assumed maximum permissible contact angle θ=110°, it follows that there is a contact angle parameter) g(110°)=1.047. For the cavity geometry shown in FIG. 10 with $3s=4w=6r_1=6r_2$ and d=0, it follows that $AR_1$=1.167>1.047=g(110°) and $AR_2$=0.333>0.047=g(110°)−1, i.e. both conditions are satisfied, which indicates complete filling. By contrast, for the cavity geometry shown in FIG. 11 with $s=d=2r_1=2r_2=2w$, $AR_1$=0.6<1.047=)g(110°) and $AR_2$=0.2>0.047=g(110°)−1, and so complete filling cannot be assured here.

Figure 12:
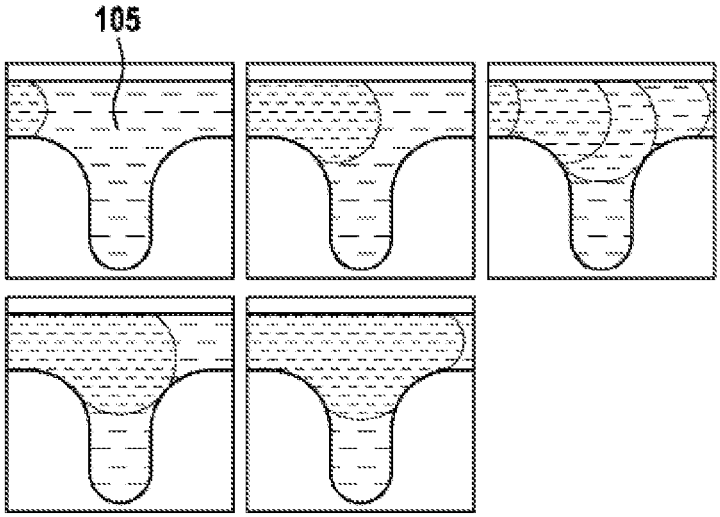
FIG. 12 schematic diagrams of a propagation of a biphasic interface during a layering process in a cavity in one working example.

FIG. 12 shows schematic diagrams of a propagation of a biphasic interface during a layering process in a cavity 105 in one working example. In addition to filling of microfluidic structures, the calculation method can also be applied to interfaces that form between two mutually immiscible liquids. FIG. 12 shows a schematic of four microscope images that show the propagation of a biphasic interface between water (dark-colored here) and mineral oil through a microfluidic cavity geometry. For this purpose, the cavity 105 was first filled completely with the mineral oil and then the dark-colored water was forced into the inlet channel. The experimental result again shows good agreement with the propagation of the biphasic interface construed geometrically via the calculation method. It is obvious that there is incomplete filling of the cavity 105 with the aqueous phase. This observation is consistent with the sufficient conditions derived above for complete filling, which are not met. With g(150°)=1.366 and $s=r_1=2d=2r_2$, w=0, it follows that $AR_1$=0.4<1.366, $AR_2$=0.2<0.366, such that the mineral oil cannot be displaced completely from the cavity 105 by the dark-colored water.

Figure 13:
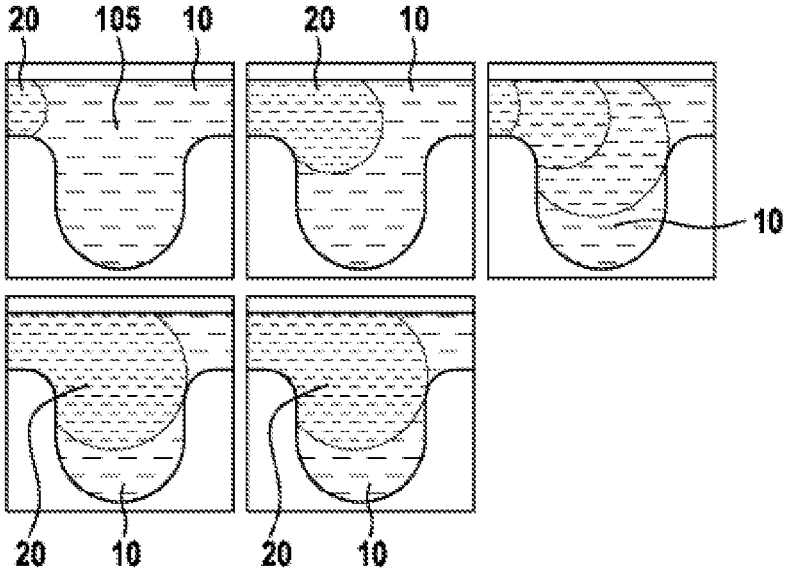
FIG. 13 schematic diagrams of a propagation of a biphasic interface during a layering process in a cavity in one working example.

FIG. 13 shows schematic diagrams of propagation of a biphasic interface during a layering process in a cavity 105 in one working example. What is shown is an example of an application of the calculation method with regard to the design of a cavity that permits the aliquoting of a fluid by blanketing with a second fluid immiscible with the first fluid. In a first step, the cavity 105 is filled, for example, with a PCR master mix as sample liquid 10. FIG. 13 shows a schematic of four microscope images that have been taken during layering with oil as sealing liquid 20. The contact angle of the oil which is established in the displacement of the PCR master mix is sufficiently large that a portion of the PCR master mix remains in the cavity shape of the microfluidic channel and is layered with the oil. The portion of the PCR master mix that remains in the cavity shape after layering, i.e. the volume enclosed, can be adjusted both via the geometry of the cavity and via the contact angle which is established between the two fluids. With g(130°)=1.166 and $s=r_1=r_2$, d=w=0, it follows $$AR_1 = \frac{2r_2 + w}{s + r_1 + d} = 1 < 1.166,\ AR_2 + \frac{r_2}{s + r_1 + d} = 0.5 > 0.166,$$

such that the criterion (I) derived indicates incomplete displacement of the first fluid, which leads to the desired layering of the first fluid.

Figure 14:
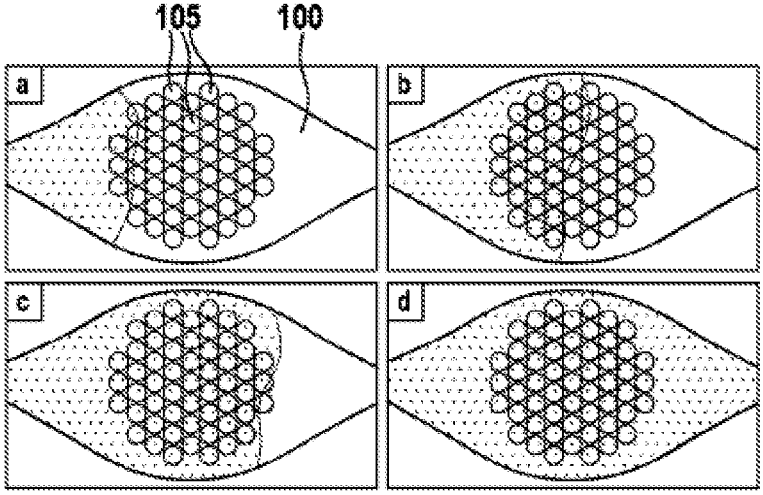
FIG. 14 schematic diagrams of a chamber in one working example during a filling process in top view.

FIG. 14 shows schematic diagrams of a chamber 100 in a working example during a filling process in top view.

Figure 15:
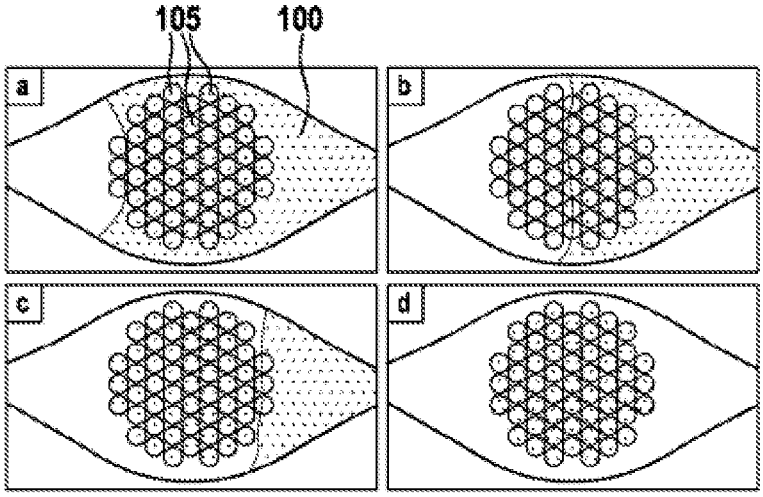
FIG. 15 schematic diagrams of a chamber from FIG. 14 during a layering process in top view.

FIG. 15 shows schematic diagrams of a chamber 100 from FIG. 14 during a layering process in top view.

FIGS. 14 and 15 show, in schematic form, an experimental result for aliquoting of a fluid in an array of 55 cavities each with a volume of 25 nl. The cross-sectional geometry of the cavities 105 is designed such that complete filling of the cavities 105 with a PCR master mix is first achieved, as shown in FIG. 14, and then layering of the cavities by means of mineral oil, as shown in FIG. 15.

Figure 16:
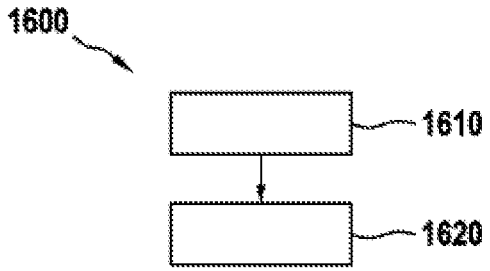
FIG. 16 a flow diagram of a method of aliquoting in one working example.

FIG. 16 shows a flow diagram of a method 1600 of aliquoting in one working example. The method 1600 may be executed, for example, by means of a microfluidic device as described above for FIGS. 1 to 15. In a first step 1610, the sample liquid 10 is introduced into the chamber 100. The geometry of the chamber 100 defined depending on the wetting characteristics, especially the contact angle $\theta_1$ of the sample liquid 10, more specifically of the inlet channel and especially of the cavities 105, achieve the effect that the meniscus of the sample liquid 10 is suitably shaped, for example in concave or convex form, while the liquid 10 flows into the cavities 105. This can achieve the effect that the cavities 105 are completely filled with the sample liquid 10. Subsequently, in a further step 1620, the sealing liquid 20 is introduced into the chamber 100. By contrast with the sample liquid 10, the meniscus of the sealing liquid 20 is shaped differently, for example in convex form, by virtue of the greater contact angle $\theta_2>\theta_1$ that exists here and the defined geometry of the chamber 100. This achieves the effect that portions of the sample liquid 10 are enclosed by the sealing liquid 20 in the cavities 105.

Figure 17:
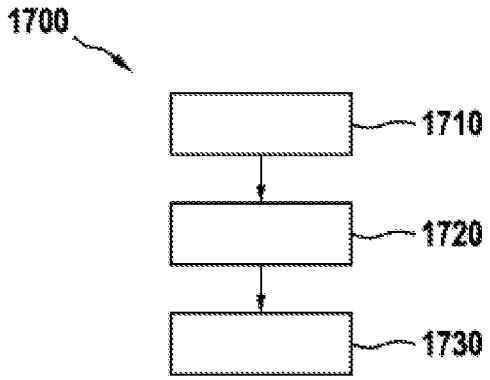
FIG. 17 a flow diagram of a method of producing a microfluidic device in one working example.

FIG. 17 shows a flow diagram of a method 1700 of producing a microfluidic device in one working example, for instance the device described above with reference to FIGS. 1 to 15. In a step 1710, wetting information representative of the respective wetting characteristics of the sample liquid and sealing liquid, for instance the contact angles thereof depending on a material of the chamber of the device, is read in. In a further step 1720, using the wetting information, a geometry suitable for complete filling and sealing of the cavities is defined. For example, the geometry here may be selected from a multitude of defined, already calculated geometries that are each assigned to different wetting characteristics. The geometries have been calculated, for example, using the above-described calculation method. In a step 1730, the chamber is shaped in accordance with the defined geometry in a suitable manufacturing method, for instance an additive or subtractive or high-throughput method.

Figure 18:
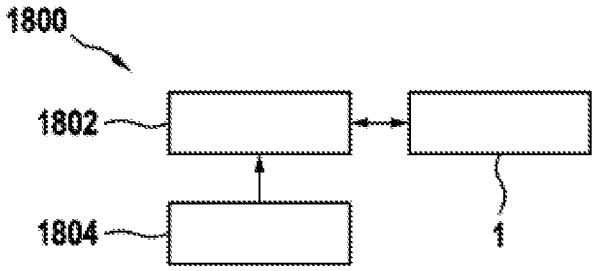
FIG. 18 a schematic diagram of a microfluidic system in one working example.

FIG. 18 shows a schematic diagram of a microfluidic system 1800 in one working example. The system 1800 comprises the device 1, a pump unit 1802 fluidically coupled to the device 1 for pumping of the sample liquid and sealing liquid through the chamber of the device 1, and a controller 1804 for actuating the pump unit 1802. The microfluidic system 1800 therefore especially enables fully automated aliquoting of the sample liquid by means of the device 1.

If a working example comprises an "and/or" linkage between a first feature and a second feature, this should be read such that the working example in one embodiment has both the first feature and the second feature, and in a further embodiment has either only the first feature or only the second feature.

The invention claimed is:

1. A method of aliquoting a sample liquid using a sealing liquid in a microfluidic device, the sample liquid and the sealing liquid having different wetting characteristics and being configured to be combined with one another to form a biphasic system composed of two phases separated from one another by an interface, the microfluidic device having a chamber with at least one inlet channel configured for introduction of the sample liquid and of the sealing liquid and with a multitude of cavities configured to be filled via the at least one inlet channel, the at least one inlet channel and the cavities having a geometry defined depending on the respective wetting characteristics of the sample liquid and of the sealing liquid, the method comprising:

introducing a sample liquid, having a contact angle wetting characteristic, such that a meniscus of the sample liquid is suitably shaped by the defined geometry and the contact angle present in the sample liquid in order to fill the cavities with the sample liquid; and introducing a sealing liquid, having a contact angle wetting characteristic greater than the contact angle of the sample liquid, after the sample liquid has been introduced such that a meniscus of the sealing liquid, by virtue of the contact angle present in the sealing liquid, and the defined geometry, is suitably shaped in order to blanket the filled cavities with the sealing liquid.

2. The method as claimed in claim 1, further comprising introducing one or more of at least one reagent and at least one additive into the cavities prior to the introduction of the sample liquid.

3. The method as claimed in claim 2, wherein the one or more of the at least one reagent and the at least one additive is dried in the cavities in the introduction.

4. The method as claimed in claim 3, wherein introducing further includes:

a first drying process in which the reagent is dried, and a second drying process in which the additive is dried, the second drying process following the first drying process.

5. The method as claimed in claim 1, further comprising:

adjusting a temperature of the sample liquid to a reaction temperature; and one or more of putting the chamber in an oblique position and setting the chamber in a rotating motion.

6. The method as claimed in claim 1, further comprising heating a liquid-guiding section of the microfluidic device one or more of upstream and downstream of the cavities to a degassing temperature so as to degas one or more of the sample liquid and the sealing liquid.

7. The method as claimed in claim 1, wherein introducing the sealing liquid includes introducing the sealing liquid at a temperature at least as high as a temperature of a liquid present in the cavities.

8. A microfluidic device for aliquoting a sample liquid using a sealing liquid, the sample liquid and the sealing liquid having different wetting characteristics and being configured to be combined with one another to form a biphasic system composed of two phases separated from one another by an interface, the microfluidic device comprising:

a chamber having (i) at least one inlet channel configured to introduce the sample liquid and the sealing liquid and (ii) a multitude of cavities configured to be filled via the at least one inlet channel, the at least one inlet channel and the cavities having a geometry defined depending on the respective wetting characteristics of the sample liquid and the sealing liquid, wherein the geometry of the at least one inlet channel and the cavities is defined using wetting information representative of the wetting characteristics of the sample liquid and the wetting characteristics of the sealing liquid, the chamber with the at least one inlet channel and the cavities configured in accordance with the defined geometry.

9. The microfluidic device as claimed in claim 8, wherein the cavities are rounded.

10. The microfluidic device as claimed in claim 8, wherein a respective width of the cavities is greater than a maximum extent of a meniscus of the sample liquid.

11. The microfluidic device as claimed in claim 8, wherein the cavities have one or more of at least partly hydrophilic surface characteristics, different geometries, and different volumes.

12. The microfluidic device as claimed in claim 8, further comprising:

a deaeration chamber fluidically coupled to the chamber and configured to deaerate the microfluidic device; and a temperature controller configured to heat the deaeration chamber and to degas one or more of the sample liquid and the sealing liquid.

13. A microfluidic system, comprising:

a microfluidic device configured to aliquot a sample liquid using a sealing liquid, the sample liquid and the sealing liquid having different wetting characteristics and being configured to be combined with one another to form a biphasic system composed of two phases separated from one another by an interface, the microfluidic device including a chamber that has (i) at least one inlet channel configured to introduce the sample liquid and the sealing liquid and (ii) a multitude of cavities configured to be filled via the at least one inlet channel, the at least one inlet channel and the cavities having a geometry defined depending on the respective wetting characteristics of the sample liquid and the sealing liquid, wherein the geometry of the at least one inlet channel and the cavities is defined using wetting information representative of the wetting characteristics of the sample liquid and the wetting characteristics of the sealing liquid, the chamber with the at least one inlet channel and the cavities configured in accordance with the defined geometry;

a pump unit configured to pump liquids through the chamber of the microfluidic device; and a controller configured to actuate the pump unit.

14. The method of claim 1, wherein:

the defined geometry of the inlet channel and cavities and the contact angle present in the sample liquid produce a concave meniscus within the cavities; and the defined geometry of the inlet channel and cavities and the contact angle present in the sealing liquid produce a convex meniscus within the cavities.

* * * * *